US006902490B1

(12) United States Patent
Swearman

(10) Patent No.: US 6,902,490 B1
(45) Date of Patent: Jun. 7, 2005

(54) BILLIARD GAMES

(76) Inventor: Jack Swearman, 11950 Gladhill Bros. Rd., Monrovia, MD (US) 21770

( * ) Notice: Subject to any disclaimer, the term of this patent is extended or adjusted under 35 U.S.C. 154(b) by 0 days.

(21) Appl. No.: 10/849,095

(22) Filed: May 20, 2004

(51) Int. Cl.[7] ..... A63D 15/00
(52) U.S. Cl. ..... 473/1; 473/14
(58) Field of Search ..... 473/1–4, 6, 9, 473/10, 14

(56) References Cited

U.S. PATENT DOCUMENTS 3,985,355 A * 10/1976 Shoemaker ..... 473/18
4,984,788 A * 1/1991 Harriman ..... 473/41
5,026,052 A * 6/1991 Shelnutt ..... 473/18

FOREIGN PATENT DOCUMENTS

GB 2339151 A * 1/2000 ..... A63D/15/00
WO WO 9724167 A1 * 7/1997 ..... A63D/15/00

* cited by examiner

*Primary Examiner*—Mitra Aryanpour
(74) *Attorney, Agent, or Firm*—Richard L. Huff

(57) ABSTRACT

Four billiard games. In the first, for four players, sixteen object balls making up four color groups of four balls each are used. The object is to be the last player to have balls on the table. In the second, for three players, fifteen object balls making up three color groups of five balls each plus an eight-ball are used. The object is to pocket all of the balls of one color group plus the eight-ball. In the third, for four players, sixteen object balls making up four color sets of four balls each plus an eight-ball are used. The object is to pocket all of the balls of one color plus the eight-ball. In the fourth, for two or more players, sixteen balls made up of eight color sets of two balls each are used. Points are scored by consecutively pocketing two balls of the same color.

7 Claims, 2 Drawing Sheets

BILLIARD GAMES

CROSS-REFERENCE TO RELATED APPLICATIONS

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION (1) Field of the Invention

This invention relates to pocket billiard games played on a conventional table with a novel set of balls and rules devised to create simple rules, increase the possibilities for strategy, and increase spectator interest.

(2) Description of the Related Art

Pocket billiards is conventionally played on a generally rectangular table having a playing surface twice as long as it is wide. Six pockets are provided, one at each of the four corners of the rectangle and one at each center of the two long boundaries, or rails, of the table. Varying numbers of balls, identical in diameter and small enough to be able to enter pockets smoothly, are utilized as targets. In general, one ball, commonly white and known as the cue ball, is propelled by being struck by an instrument known as the cue stick. The usual object of pocket billiard games is to cause the cue ball to contact one or more of the other balls, known as object balls, and further cause one or more object balls to enter pockets.

Numerous pocket billiard games are known in the prior art. Many are described in The Official Rule Book for All Pocket & Carom Billiard Games, published in Chicago by the Billiard Congress of America in 1974 ("BCA 74")). Still others are described in Billiards: The Official Rules & Records Book, published by the Billiard Congress of America, 4345 Beverly Street, Suite D, Colorado Springs, Colo. 80918-5916, in 2003 ("BCA 03")). Billiard terms and games referred to herein, unless otherwise specified, are to be understood as defined in BCA 03. All the pocket billiard games mentioned herein, as well as the present invention, utilize a cue ball in addition to the object balls described.

Several of the most popular spectator pocket billiard games are nine-ball, eightball and snooker. Efforts have been made to expose these games to a wide television audience, but each suffers from competitive drawbacks that reduce audience interest.

Nine-ball is played with nine object balls, labeled with the numerals 1 through 9 and racked at the foot of the table in the form of a diamond. The ball nearest the center of the table, called the "apex ball", is positioned on the foot spot. The opening shot, or break shot is played forcefully with the goal of scattering the balls widely and pocketing at least one of them. This is known as an "open break" and at least four object balls must contact some cushion for the shot to be legal. The player who is successful at pocketing a ball on the break shot may continue playing. At each shot, the player's cue ball must first contact the lowest-numbered ball remaining on the table. The player who first pockets the nine-ball legally is the winner of the "rack". A nine-ball match is won by the first player who wins a predetermined number of racks.

The skill of professional players at nine-ball is so high that there is a substantial chance that the player who opens the game will "run out", that is, pocket a ball on the break shot and then sink all the remaining object balls in numerical order and, thus, winning by pocketing the nine-ball last. Since the winner of a rack of nine-ball by the rules is allowed to open the next rack, a skilled player may win several games consecutively without the opponent having a single opportunity to shoot. This aspect of the game reduces competitiveness and exacts a heavy penalty for missing, since the opponent may win the match, or draw insurmountably ahead, when once given the chance to play.

From the spectator viewpoint, nine-ball provides little of the suspense believed necessary to sustain interest. Because the rules of the game dictate which ball is to be played next under all circumstances, there is no opportunity for the spectator to ponder or speculate on what shot the player will attempt. Furthermore, the relatively small number of balls used results in a rack of nine-ball lasting only a short time, typically from one to five minutes In nine-ball, a player who fouls by failing to contact the lowest-numbered ball on the tablet or who "scratches" by pocketing the cue ball is subjected to the severe penalty of "cue ball in hand", under which his turn at the table ends and the next player is permitted to place the cue ball anywhere on the table before shooting. The effect of this rule is that a single foul or scratch often leads to loss of the game by giving the opponent an overwhelming advantage.

Eight-ball is the most popular pocket billiard game in the United States. It is played with a standard rack of 15 object balls placed in a triangle. Of these, the balls numbered 1 through 7, inclusive, bear solid colors in addition to numerals and are known as "solids". The balls numbered 9 through 15, inclusive, bear visual stripes in addition to numerals and are known as "stripes". The eight-ball is solid black except for an area bearing the numeral "8". The balls are racked so that the apex ball lies on the foot spot. The opening player must attempt an open break. When a player legally pockets a ball subsequent to the break shot, the "group", that is, stripes or solids, to which that ball belongs becomes that player's group for the remainder of the rack. A player must contact a ball of his or her group first every shot and keeps playing as long as a ball of that group is legally pocketed. Only when all the balls of a player's group have been pocketed may that player attempt to pocket the eight-ball. The player who first legally pockets the eight-ball is the winner. The break shot on subsequent racks alternates between players, regardless of who won the preceding rack.

Because the balls of a player's group, that is, stripes or solids, need not be contacted or pocketed in any particular order, the player at the beginning of a rack has numerous balls at which to play and may plan a sequence leading to a runout. Therefore, eight-ball suffers from the same deficiency as nine-ball in that the chance of a runout is high and the penalty for a foul is cue ball in hand, by which competitiveness is reduced. Additionally, eight-ball can be played by only two players or two teams of players, thus limiting the options as to the number of participants.

Snooker is the most popular pocket billiard game in the United Kingdom and the Far East. It is played on a 12-foot table having narrow pockets and with 21 small object balls consisting of 15 solid red object balls and six other object balls known as colors, each of a different solid color. The 15 reds are racked in a triangle, while the colors are placed at the beginning of the game, or "frame", on predefined spots on the table. The general object of snooker is to pocket a red ball, then a color, then another red ball and another color, alternately, until no more red balls remain on the table. At that point, the colors must be pocketed in a predetermined order. Any color pocketed immediately after a red is pocketed is returned to the table. A player receives one point for pocketing a red and a greater number of points for pocketing a color. The colors, although the balls themselves do not bear numerals, are assigned point values from 2 to 7. Snooker possesses a complex system of penalties for infractions of the rules. For example, failing to contact a color when required or failure to contact a red when required is a foul, for which from four to seven points is to be added to the opponent's score. The frame terminates when all balls have been pocketed. The player with the larger number of points at that time is the winner.

It is not regarded as advantageous to play a break shot in snooker because of the low probability of pocketing a ball. Therefore, a frame of snooker generally begins with positional maneuvering, in which the players attempt to leave the cue ball in a disadvantaged location for the opponent, rather than try to pocket a ball.

In contrast to nine-ball, which is too rapid, snooker is too slow. Even if the players never miss a shot, 36 balls must be pocketed before the frame ends (fifteen reds, each followed by a color, then followed by six colors in order.) With the narrow pockets, a single frame may take more than 30 minutes for professional players and considerably longer for beginners. Because points are awarded for defensive play, that is, placing the cue ball in such a position that the opponent cannot hit the required ball, stretches may occur in which the players are not even attempting to pocket a ball, which lengthens the game and causes tedium for players and spectators alike.

Perhaps the biggest drawback in the most popular billiard games is the inability of more than two people to participate. Thus, in a gathering of three or four people, only two may play while the others are spectators.

BRIEF SUMMARY OF THE INVENTION

It is the object of the present invention to provide billiard games which may be played by more than two players and in which the range of skill among the players may be great while still maintaining interesting games to play and watch.

This invention introduces four games; four player cutthroat, three player color eight-ball, four player color eight-ball, and two ball color wipeout.

Four player cutthroat is played by four players, which is considered to be the most ideal group for enjoyable social play. Individual ball groupings are by color, not by number. This game is ideal for mixed skill levels. This game makes use of four color groups of four balls each and uses a sixteen-ball diamond-shaped rack.

Three player color eight-ball is played by three players, making it ideal for the traditional eight-ball game when there are three players wishing to play. This game uses three color groups of five balls each. A diamond-shaped, sixteen-ball rack holds the three sets of balls plus the eight ball.

Four player color eight-ball is played by four players. This game is ideal for those who like the traditional eight-ball when there are four players wanting to play and there is only one table. This game allows the players to play as individuals rather than as members of a team. The balls are grouped into four color groups of four balls each. A diamond-shaped, sixteen-ball rack holds the balls. The eight-ball is spotted on the head spot before play begins.

Two ball color wipeout is suitable for two or more players. This game is ideal for players with intermediate skills. The game is similar to the known game of cribbage, but is much easier to follow. The game is based on color pairs rather than number pairs. A point is scored when both balls of a single color are pocketed one after another. No searching for numbered balls that are mixed solid and stripe is necessary to determine which pair can be pocketed to make another point.

DETAILED DESCRIPTION OF THE INVENTION

Figure 1:
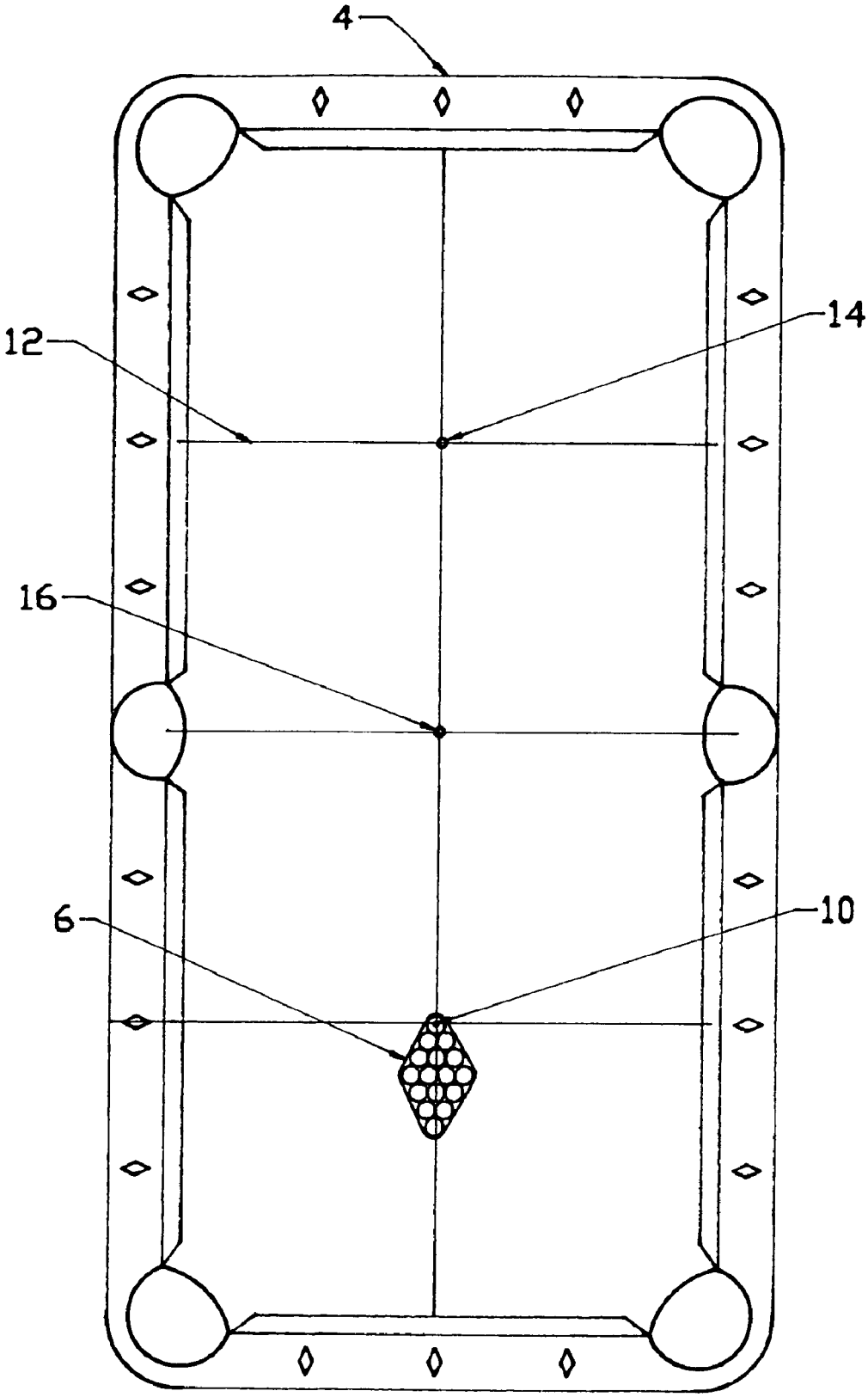
FIG. 1 is a plan view of a conventional billiards table showing the location of the features referred to in the following description. The table holds a diamond-shaped, sixteen-ball rack.
Figure 2:
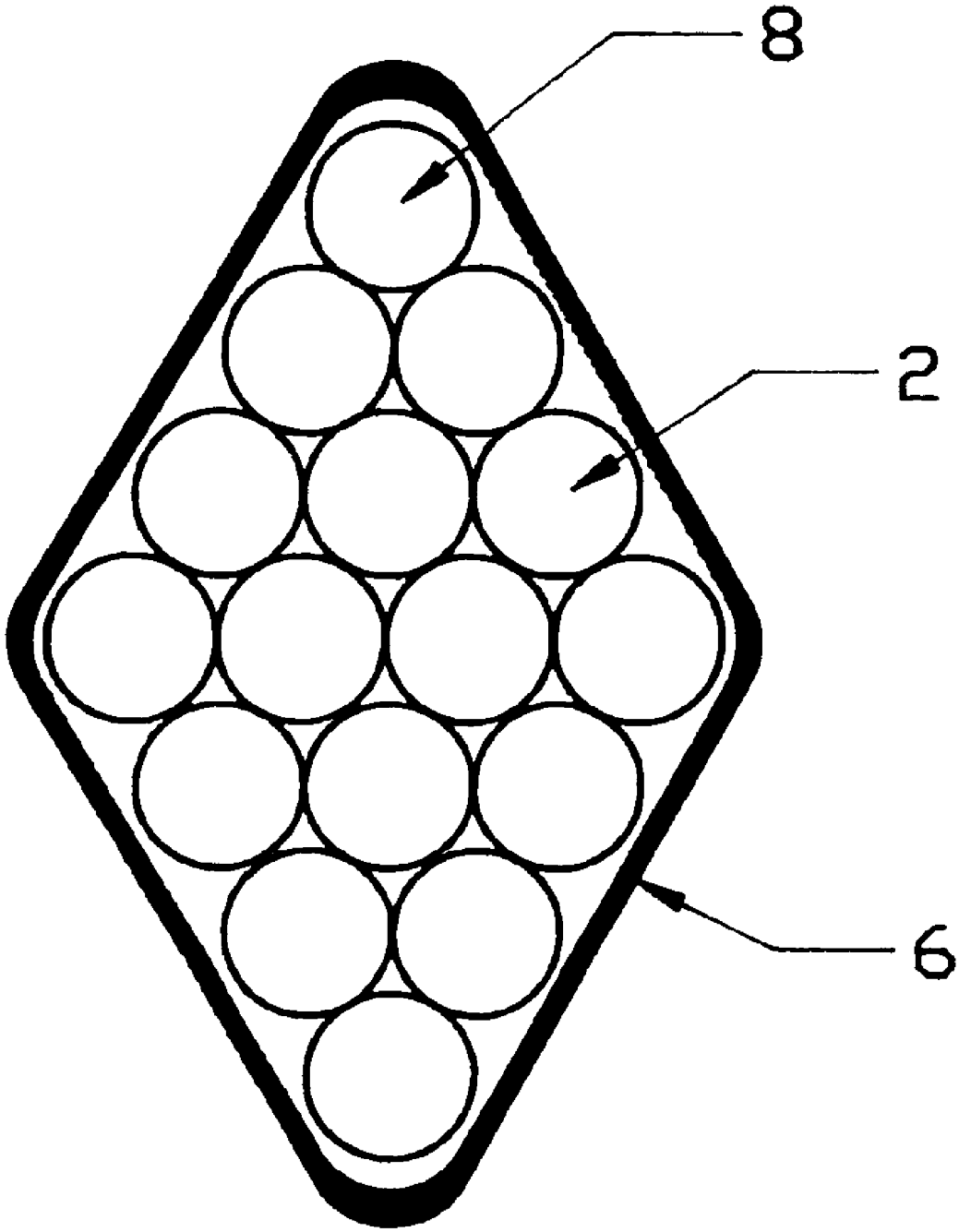
FIG. 2 is a plan view of a diamond-shaped, sixteen-ball rack containing sets of balls, each set having a different color.

It is to be clearly understood that, for the four games described below, except when clearly contradicted by the special rules set forth for each game, the General Rules of Pocket Billiards as set forth in BCA 03 apply.

The game of four player color cutthroat will be described.

Type of Game

This game is designed for social play rather than for serious competition. It is a fast-playing game for groups with varying skills using simple rules. The intent of the game is to remove all of the opponents' balls 2 from the table 4 and have a ball(s) 2 of your color group still on the table.

Players

The game is designed for four players.

Balls Used

A set of sixteen un-numbered balls 2 made up of four color groups of four balls 2 each is used as the object balls 2.

The Rack

A diamond-shaped, sixteen-ball rack 6 that sets a pattern of 1-2-3-4-3-2-1 is used to rack the balls 2. The head ball 8 is placed on the foot spot 10. One ball 2 from each color group is placed on each corner of the rack 6. All other balls 2 are placed at random.

Color group and order of shooting for each player should be determined before play begins.

Object of The Game

The object of the game is to legally pocket your opponents' balls 2 before they pocket your group of balls 2. The last player to have balls 2 on the table 4 is the winner.

Scoring

No point value is given to any ball 2 in any group. A player wins after pocketing all other players' balls 2 and still having at least one ball 2 on the table. An exception to this would be if a current player chooses to pocket a ball 2 from his or her group to gain position or to continue to play. If, however, the player makes this choice and shoots off his or her last ball 2 and then fails to clear all the opponents' balls 2 from the table 4, the player is out and the game continues between the players still active. If only one player has balls 2 on the table 4, that person wins automatically.

Opening Break

The order of shooting should be determined before play begins. The beginning break should be determined by some agreeable method and from then on player take turns breaking. The starting player must make an open break satisfactory to the incoming player or that player may request that the balls 2 be re-racked and make the break.

Rules of Play

1. Players must decide before the game whether to play call pool or not.

2. A legal shot requires that the cue ball (not shown) touch a ball 2 and then a cushion or cause an object ball 2 to touch a cushion or pocket a ball 2. If a player commits a foul, the next player has ball in hand.

3. A player may play any combination, bank, carom, or even hit his or her own ball 2 first in an attempt to pocket an opponent's ball 2. The player may even choose to pocket his or her own ball 2 in an attempt to continue shooting.

4. If successive games are played, each player takes a turn breaking in the order they have been shooting since the opening break. Each player continues with the same color group throughout the session or match.

5. If a player scratches, the other players are allowed to spot one of their pocketed balls 2 if they have any. The order of spotting on the foot spot 10 and behind it is in the order of shooting as determined at the beginning of the play.

Cue Ball Scratching or Jumping off the Table

In the event of cue ball scratching or jumping off the table, the next player has ball in hand behind the head string 12.

The game of three player color eight ball will now be described.

Type of Game

This is a variation of eight-ball in which three players participate, each player having a set of five un-numbered colored balls 2.

Players

There are three players.

Balls Used

The game is played with a cue ball, eight-ball (or black ball) and 15 un-numbered object balls 2 divided into three color groups of 5 balls 2 each.

The Rack

A diamond-shaped, sixteen-ball rack 6 that sets a pattern of 1-2-3-4-3-2-1 is used to rack the balls 2. The head ball 8 is set on the foot spot 10. The eight (black) ball is placed in the forward center position. The head and rear corner balls 2 are the same color and the left and right side corner balls 2 are of a different color.

Object of The Game

To win, a player must legally pocket all the balls 2 of his or her color set and the eight (black) ball.

Scoring

No point value is given to any ball 2 in any group. A player wins after legally pocketing all of the balls 2 in his or her color group and the eight (black) ball.

Opening Break

The choice of order of shooting and color group can be made prior to starting play if desired. However, color group selection can be determined as play progresses and balls 2 are pocketed.

The beginning break should be determined and from then on players should take turns breaking.

Rules of Play

1. Players should decide before play begins whether to play call pool or not. They should also determine whether legal play requires that a player must hit a ball 2 from the player's color group first in attempting to pocket a ball 2 or whether any combination, bank, carom or contact with someone else's color group first in attempting to pocket a ball 2 is legal play.

2. A legal shot requires that the cue ball touches an object ball 2 and then a cushion or causes an object ball 2 to touch a cushion or pockets a ball 2. If a player causes a foul, the next player has ball in hand.

3. If the player who makes the break pockets balls 2 from more than one color group, the player has the choice of selecting the color he or she wishes to play and the other pocketed ball(s) 2 are spotted The eight (black) ball can be used in any manner to attempt to pocket an object ball 2.

4. If the eight (black) ball is pocketed before the end of the game, it is spotted on the foot spot 10. If the eight (black) ball is pocketed and the cue ball scratches, the eight (black) ball is spotted and the next player has ball in hand behind the head string 12.

5. If successive games are played, each player takes a turn breaking in the order that was established before play was started.

Cue Ball Scratching or Jumping off the Table

In the event of cue ball scratching or jumping off the table, the next player has ball in hand behind the head string. 12.

The game of four player color eight-ball will be described.

Type of Game

The game is a variation of eight-ball in which four players participate, each player having a set of four un-numbered colored balls 2.

Players

There are four players.

Balls Used

The game is played with a cue ball, eight-ball (or black ball) and 16 un-numbered object balls 2 divided into four color groups of four balls 2 each.

The Rack

A diamond-shaped, sixteen-ball rack 6 that sets a pattern of 1-2-3-4-3-2-1 is used to rack the balls 2. One ball 2 from each color group is placed on each corner of the rack 6. The rest of the balls 2 are placed at random. The eight (black) ball is placed on the head spot 14 before play begins.

Object of the Game

One player must legally pocket all the balls 2 of his or her color group and the eight (black) ball to win.

Scoring

No point value is given to any ball 2 in any group. A player wins after legally pocketing all of the balls 2 in his or her color group and the eight (black) ball.

The order of shooting should be determined before play begins. Beginning break should be determined and from then on players should take turns breaking.

Opening Break

The balls 2 used are the cue ball, eight (black) ball and sixteen balls 2 divided into four color groups of four balls 2 each. Color selection can be made prior to starting play if desired. However, color group selection can be determined as play progresses and balls 2 are pocketed.

Rules of Play

1. Players should decide before play begins whether to play call pool or not. Players should also decide whether a legal shot requires a player to hit a ball 2 from his or her color group first or whether any combination, bank, or carom using any ball 2 is to be considered legal play.

2. A legal shot requires that the cue ball touches an object ball 2 and then a cushion or causes a ball to touch a cushion or pockets a ball 2. If a player causes a foul, the next player has ball in hand.

3. If the player who makes the break pockets a ball 2 from more than one color group, he or she has the choice of selecting the color group he or she wishes to play and the other pocketed ball(s) 2 are spotted. The eight (black) ball can be used in any manner to attempt to pocket an object ball 2.

4. If the eight (black) ball is pocketed before the end of the game, it is spotted on the foot spot 10. If the eight (black) ball is pocketed and the cue ball scratches, the eight (black) ball is spotted and the next player has ball in hand behind the head string 12.

5. If successive games are played, each player takes a turn breaking in the order that was established before play was started.

Jumped Ball

In the event of a jumped ball, the jumped balls are spotted on the foot spot 10.

Cue Ball Scratching or Jumping off the Table

In the event of cue ball scratching or jumping off the table, the next player has ball in hand behind the head string 12.

The game of two ball color wipeout will be described.

Type of Game

The game is a variant of cribbage. The game of two ball color wipeout is a game designed for the intermediate player which is easy to follow because the ball 2 pairs are quickly identified by color and not by number.

Players

There are two or more players.

Balls Used

The balls 2 used are a set of sixteen un-numbered balls 2 divided into eight color pairs.

The Rack

The rack 6 is a diamond-shaped, sixteen-ball rack 6 that sets a pattern of 1-2-3-4-3-2-1. The head ball 8 is placed on the foot spot 10. The balls 2 are placed completely at random.

Object of the Game

To win the game, a player must score more points than any of the player's opponents.

Scoring

One point is scored for each color pair pocketed in order during a player's inning. If a companion ball 2 in a color group is not pocketed, then the pocketed ball is spotted. Order of spotting is first on the foot spot 10 then the head spot 14, next the center spot 16. If all three spots are occupied, then stacking begins behind the foot spot 10 until a spot becomes available. To score a point, two balls 2 of the same color must be pocketed in consecutive order.

Opening Break

The order of shooting should be determined before play begins. Beginning break should be determined and from then on players should take turns breaking.

The starting player must attempt an open break. If the opening break is not satisfactory to the next player, the next player can either request another break or choose to make the break himself or herself If, on the opening break, more than one ball 2 is pocketed representing different color pairs, the shooter may select to pocket a second ball 2 to complete a color pair in any order.

Rules of Play

1. To complete a wipeout, two balls 2 of the same color must be pocketed consecutively. When a player pockets a ball 2, the color companion must be pocketed next to count as a wipeout which counts as one point. The companion ball 2 does not have to be hit first but can be played in any manner in an attempt to pocket it. Any manner of playing, combination, bank, or carom can be used to pocket an object ball during the entire game.

2. When a player scores a wipeout, he or she can continue to attempt another wipeout in that inning.

3. If a player pockets more than one ball 2 when attempting to start a wipeout, the player may continue to attempt to pocket the companion balls 2 in any order. If other balls 2 are incidentally pocketed during the completion of a wipeout, they become a part of the player's pool of balls 2 for which the player may pocket companion balls 2 in any order desired to complete a wipeout. Any balls 2 for which companion balls 2 are not pocketed, are spotted and the player's inning ends.

4. If, before play is started, a number higher than eight is decided upon to be the total points to win the game, the following plan can be followed to continue from rack to rack. After fourteen balls 2 or seven pairs are pocketed, the last pair remains in position and the fourteen balls 2 are racked with the diamond-shaped, sixteen-ball rack 6 with the front and rear spaces vacant. If the remaining balls 2 are in the rack 6 space, they are first spotted on the head spot 14 and then the center spot 16 if needed. If the cue ball is in the rack 6 space, the current player has ball in hand.

5. If a player wishes to play safe, the player must cause the cue ball to touch a ball 2 and then a cushion or cause the ball 2 to touch a cushion or to pocket a ball 2. If a player causes a foul, the next player has ball in hand.

Jumped Ball in the event of a jumped ball, the jumped balls are spotted on the foot spot 10.

Cue Ball Scratching or Jumping off the Table

In the event of cue ball scratching or jumping off the table, the next player has ball in hand behind the head string 12.

Although the invention has been described and illustrated in detail, it is to be clearly understood that the same is by way of illustration and example, and is not to be taken by way of limitation. The spirit and scope of the present invention are to be limited only by the terms of the claims.

I claim:

1. A method of playing a billiard game using a billiard table and a cue ball, wherein the method comprises the steps of:

providing a billiard table with a head string and a foot spot;

providing a set of sixteen unnumbered balls made up of one black ball and three color groups of five balls each; wherein each of said color groups is distinct from the other;

providing a diamond-shaped rack with the balls set in the rack in a pattern of 1-2-3-4-3-2-1 on the table;

removing the rack;

providing a cue ball;

placing the cue ball on the table; and striking the cue ball against the racked balls;

making the rules by having players decide before the game whether or not to call pool, what constitutes a legal shot, and the results of a player committing a foul;

playing the game with three players; by placing the set of sixteen balls made up of the black ball and the fifteen unnumbered object balls divided into three color groups of five balls each on the table over the foot spot using the diamond-shaped rack that sets the sixteen balls in pattern of 1-2-3-4-3-2-1; and winning the game by pocketing all of the balls of one color group followed by the black ball; and the starting player making the break.

2. The method according to claim 1, wherein in setting the balls, the black ball is placed in the forward center position, the head and rear corner balls are the same color, and the left and right side corner balls are of a different color.

3. The method according to claim 2, wherein when a player causes a foul, the next player has ball in hand.

4. The method according to claim 3, wherein when the player who makes the break pockets balls from more than one color group, the player has the choice of selecting the color to be played and the other pocketed balls are spotted.

5. The method according to claim 4, wherein when the black ball is pocketed before winning the game, it is spotted on the foot spot.

6. The method according to claim 5, wherein when the black ball and the cue ball are pocketed in the same turn, the black ball is spotted on the foot spot and the next player has the cue ball in hand behind the head string.

7. The method according to claim 6, wherein, when the cue ball scratches or jumps off the table, the next player has ball in hand behind the head string.

* * * * *